US005841403A

United States Patent [19]

West

[11] Patent Number: 5,841,403

[45] Date of Patent: Nov. 24, 1998

[54] ANTENNA MEANS FOR HAND-HELD RADIO DEVICES

[75] Inventor: Guy J. West, Duluth, Ga.

[73] Assignee: Norand Corporation, Cedar Rapids, Iowa

[21] Appl. No.: 885,321

[22] Filed: Jun. 30, 1997

Related U.S. Application Data

[63] Continuation of Ser. No. 552,590, Nov. 3, 1995, abandoned, which is a continuation-in-part of Ser. No. 428,535, Apr. 25, 1995, abandoned.

[51] Int. Cl.[6] ..... H01Q 1/24; H01Q 1/36

[52] U.S. Cl. ..... 343/702; 343/895

[58] Field of Search ..... 343/702, 895, 343/900, 901; H01Q 1/24, 1/36, 1/38, 11/08

[56] References Cited

U.S. PATENT DOCUMENTS

| | | | |
|---|---|---|---|
| 4,612,668 | 9/1986 | Sarac | 343/702 |
| 4,644,366 | 2/1987 | Scholz | 343/895 |
| 4,740,794 | 4/1988 | Phillips et al. | 343/702 |

*Primary Examiner*—Hoanganh T. Le
*Attorney, Agent, or Firm*—Akin, Gump, Strauss, Hauer & Feld, L.L.P.

[57] ABSTRACT

An antenna for a hand-held RF transceiver terminals includes an antenna element which is encapsulated by material which does not detrimentally effect its antenna performance, but which closely conforms the antenna to the general shape of the terminal without having the antenna extend directly from the terminal.

20 Claims, 18 Drawing Sheets

ANTENNA RADIATION PATTERN

ANTENNA RADIATION PATTERN

ANTENNA RADIATION PATTERN

ANTENNA RADIATION PATTERN

ANTENNA RADIATION PATTERN

ANTENNA MEANS FOR HAND-HELD RADIO DEVICES

CROSS REFERENCE TO RELATED APPLICATIONS

The present application is a continuation of U.S. Application Ser. No. 08/552,590 filed Nov. 3, 1995, by Guy J. West, now abandoned which is a continuation-in-part of U.S. Application Ser. No. 08/428,535 filed Apr. 25, 1995, by Guy J. West now abandoned.

AUTHORIZATION PURSUANT TO 37 CFR 1.71 (d) (e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserve all copyright rights whatsoever.

1. Technical Field

The present invention relates to antennas for radio frequency devices, and in particular, to such antennas for hand-held data terminals which utilize radio frequency transceivers.

2. Background Art

Hand-held, easily portable data terminals are becoming increasingly popular. Similarly, wireless communication, for example, via radio frequency transmissions, is utilized with many of these types of devices. Such communication allows easy and advantageous communication of information from a small portable terminal to a larger remotely positioned computer or other device and, conversely, allows information from the remote terminal or base to be instantaneously conveyed to a remote hand-held terminal.

Radio communication requires a radiating element or antenna. Conventionally, antennas for hand-held terminals take the form of a small helically wound stub antenna. Such antennas provide an adequate range and reception and are preferred because their small size matches the small, hand-held size of the terminal.

Problems and deficiencies do exist with such stub antennas, however. They generally extend from the terminal housing and therefore are susceptible to contact and breakage. Also, the mere fact that they extend the outer dimensions of the terminal conflicts with the attempt to make terminals as small as possible. The mere physical presence of the stub antenna also limits placement of these devices in cooperating devices such as recharging cradles, data download mounts, and other accessories.

It would therefore be beneficial if the need for an external, outwardly extending stub-type antenna were eliminated. It is therefore a primary object of the present invention to provide a means which solves the problems and eliminates deficiencies in the art.

A further object of the present invention is to provide a means which provides an antenna which performs generally as well or better than a conventional helical stub antenna, but eliminates the antenna from having to extend outwardly from the terminal container and be subject to damage or breakage.

A further object of the present invention is to provide a means as above described which conforms generally closely to the housing of the hand-held terminal or is entirely internally contained within the hand-held terminal.

Another object of the present invention is to provide a means as above described which does not physically cause interference between the primary perimeter of the hand-held terminal and such things as recharging or data communications connection cradles.

A still further object of the present invention is to provide a means as above described which utilizes materials and positioning which renders the antenna generally omni-directional in performance, while shielding it from direct physical contact.

Another object of the present invention is to provide a means as above described which can be placed to minimally impact upon size or placement of components, connections, and ports with respect to the housing and terminal and its normal operation.

These and other objects, features, and advantages of the present invention will become more apparent with reference to the accompanying specification and claims.

DISCLOSURE OF THE INVENTION

The present invention improves upon the art by eliminating the requirement for a stub helical antenna or other generally linear-type extending antennas. The invention utilizes a radiating element which is substantially encapsulated with a material which does not materially effect its radiating and receiving performance properties, but protects it from direct contact during use of the hand-held terminal, and places the radiating element entirely inside the housing of the hand-held terminal, substantially in conformance with the exterior of the housing, or in a modular portion thereof.

The invention also utilizes connection means to the transceiving component in the terminal which effectively establishes an electrical connection between the transceiving component and the radiating element. The invention also is conformed to the specific size and shape constraints of the housing so that it minimally, if at all, represents an extension, addition, or variance from the general size and shape of the terminal housing.

The invention also utilizes materials associated with the radiating element which do not materially degrade the performance of the radiating element in terms of transmission and reception, or in terms of electrical interference with other components of the terminal.

The invention can be used with a wide range of products and eliminates the inherent problems with a stub-type antenna.

BEST MODES FOR CARRYING OUT THE INVENTION

Figure 1:
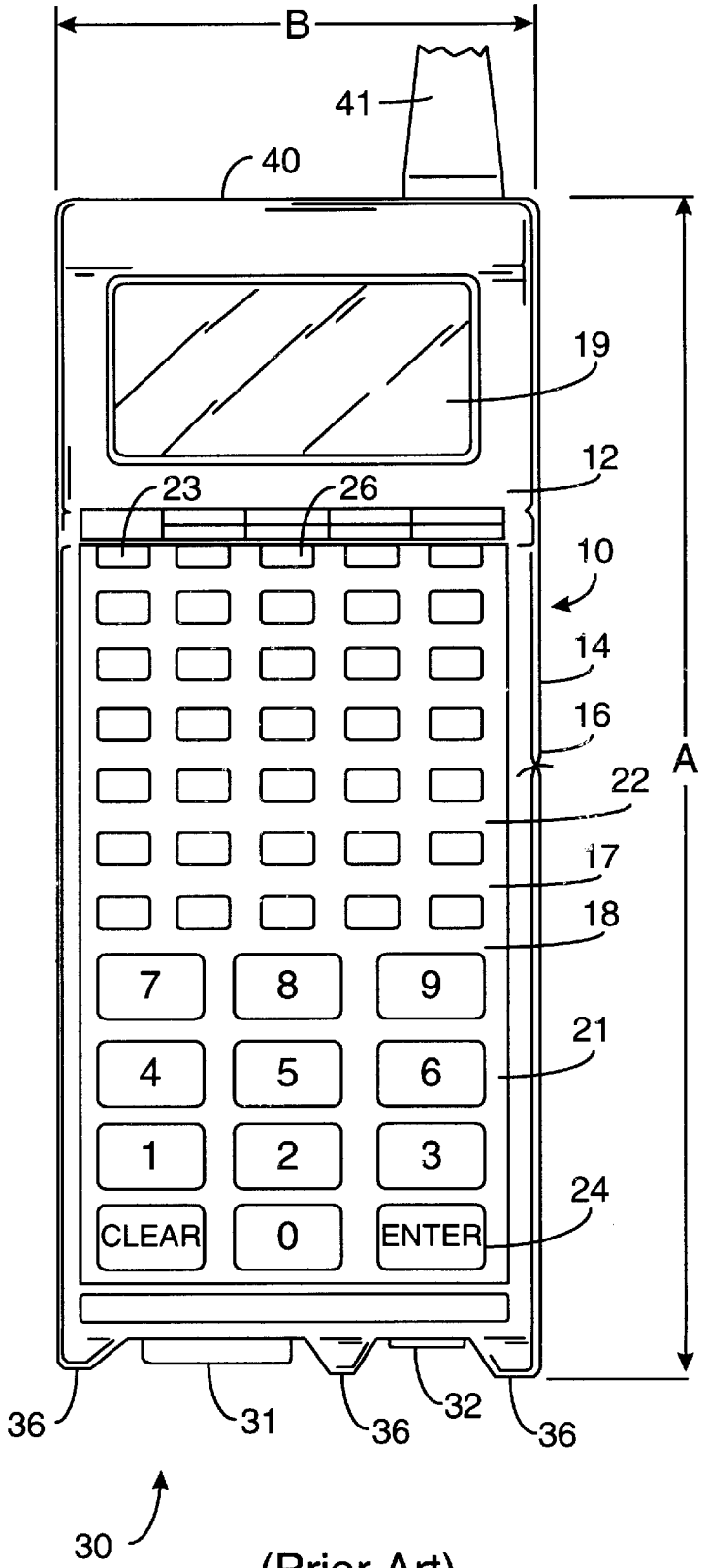
(Prior Art) FIG. 1
FIG. 1 is a top plan view of an embodiment of a hand-held terminal with which the present invention can be utilized illustrating a prior art utilization of a stub antenna as a radiating element for radio frequency communications.

To assist in a better understanding of the invention, a description of different forms and embodiments of the invention will now be described in detail. Reference will be made to the accompanying drawings. Reference numbers and letters will be used in the drawings to indicate specific parts and locations on the drawings. The same reference numerals and letters will be used throughout the drawings unless otherwise indicated.

It is to be understood that the scope of the invention is not limited to the specific embodiments discussed herein.

FIGS. 1–12

FIGS. 1–12 illustrate a specific example of the invention. A hand-held terminal (10) is fittable with removable modules. Examples are module (48) of FIG. 2 and module (51) of FIG. 3.

Figure 4:
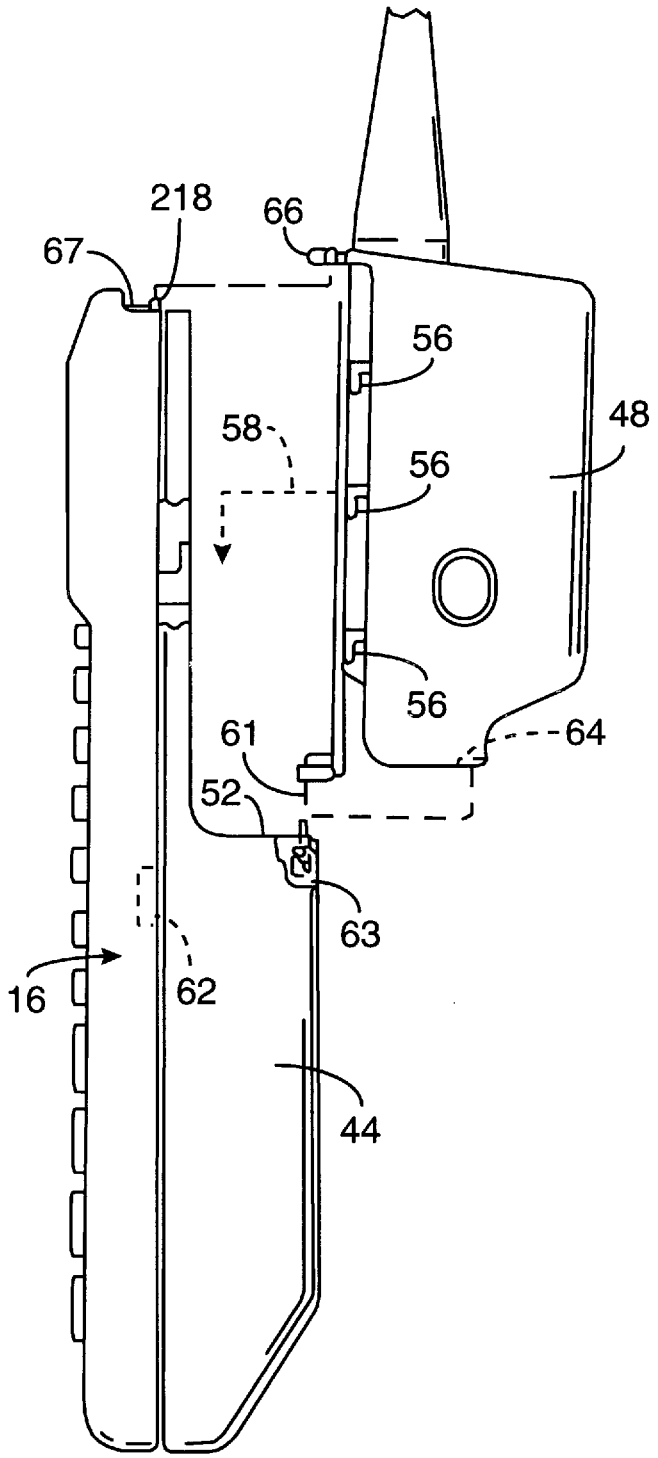
(Prior Art) FIG. 4
FIG. 4 is essentially similar to FIG. 2 but showing the modular component similar to that shown in FIG. 2 removed from the main terminal housing, including the helical stub antenna on the modular unit.
Figure 5:
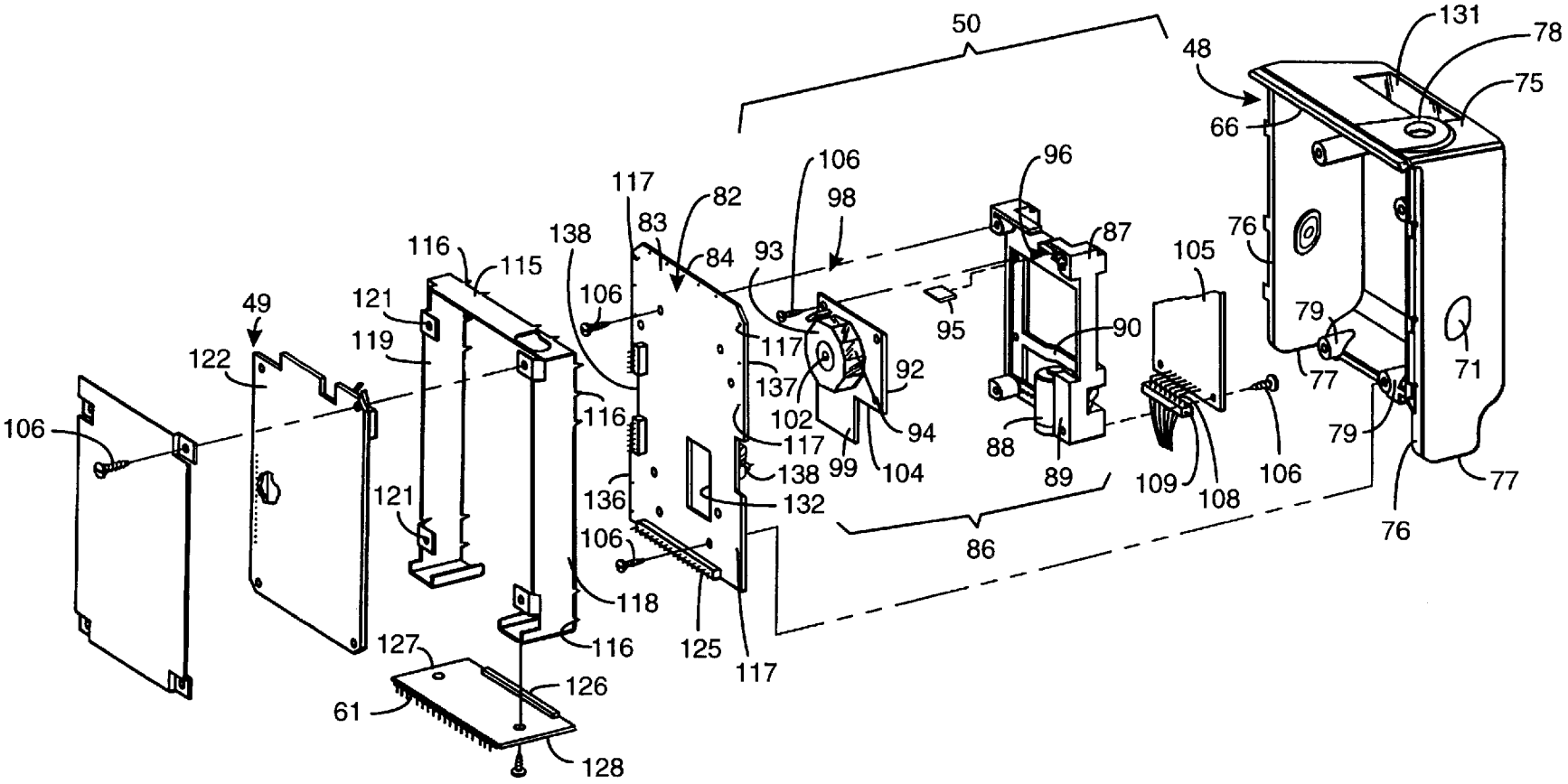
FIG. 5 is an exploded view of the modular unit of FIG. 2 without the stub antenna attached.
Figure 6A:
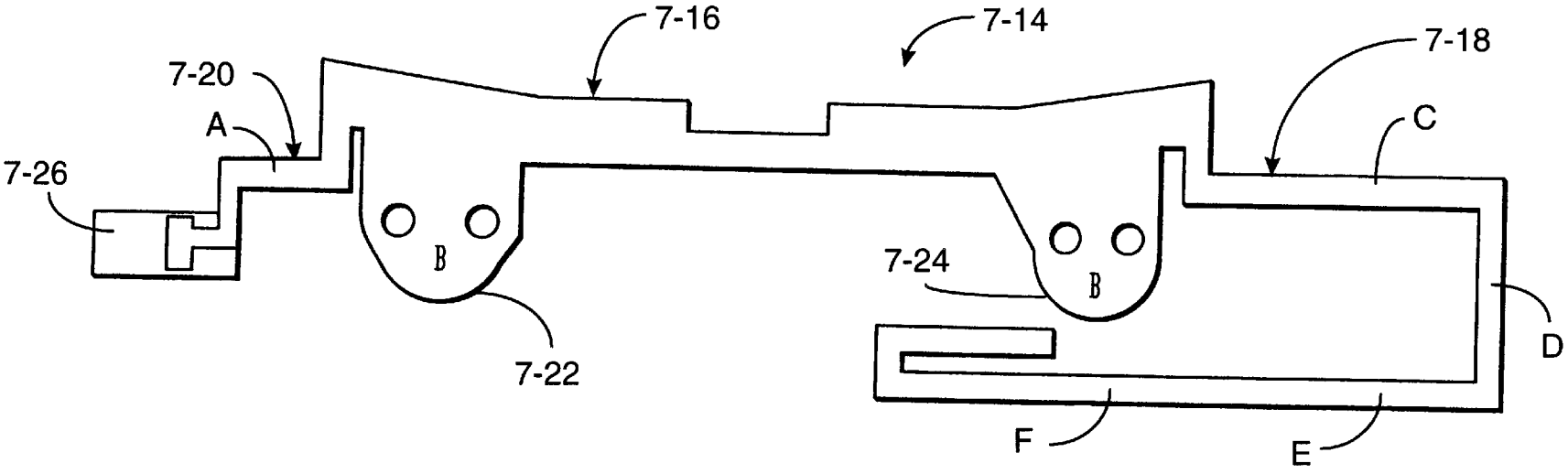
FIG. 6A is a top plan view of one embodiment of a radiating element built in accordance with the present invention in an unconformed state to the terminal housing or modular component of the terminal.
Figure 6B:
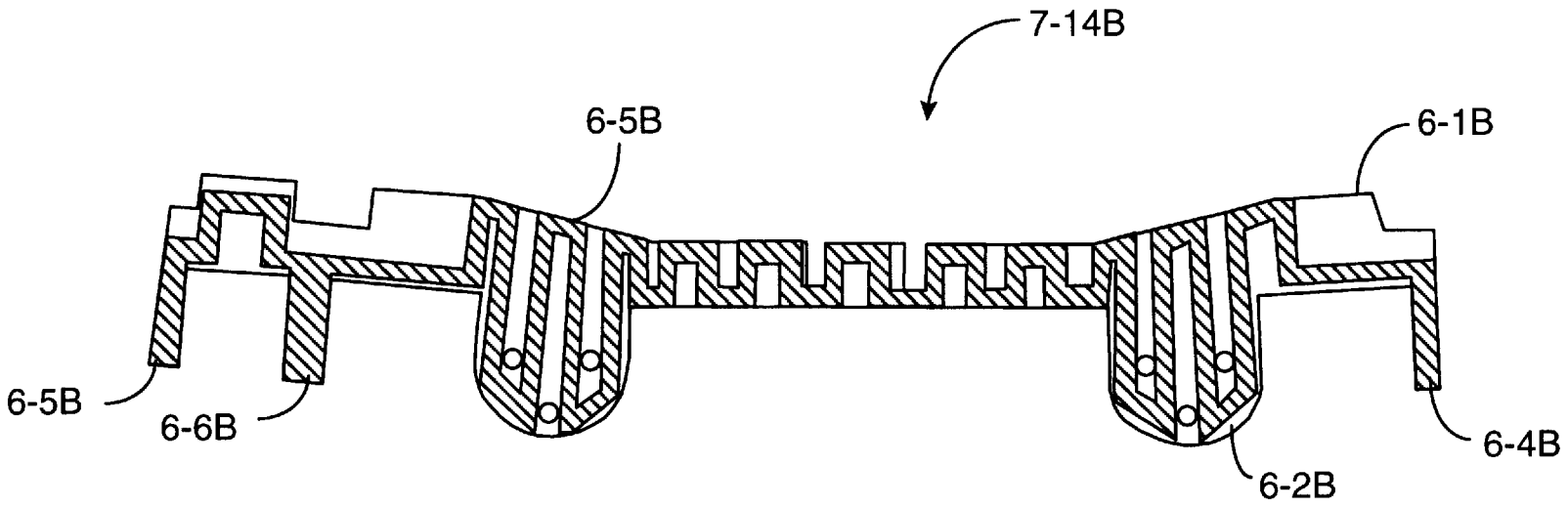
FIG. 6B is a top plan view of another embodiment of a radiating element built in accordance with the present invention in an unconformed state to the terminal housing or modular component of the terminal.
Figure 7:
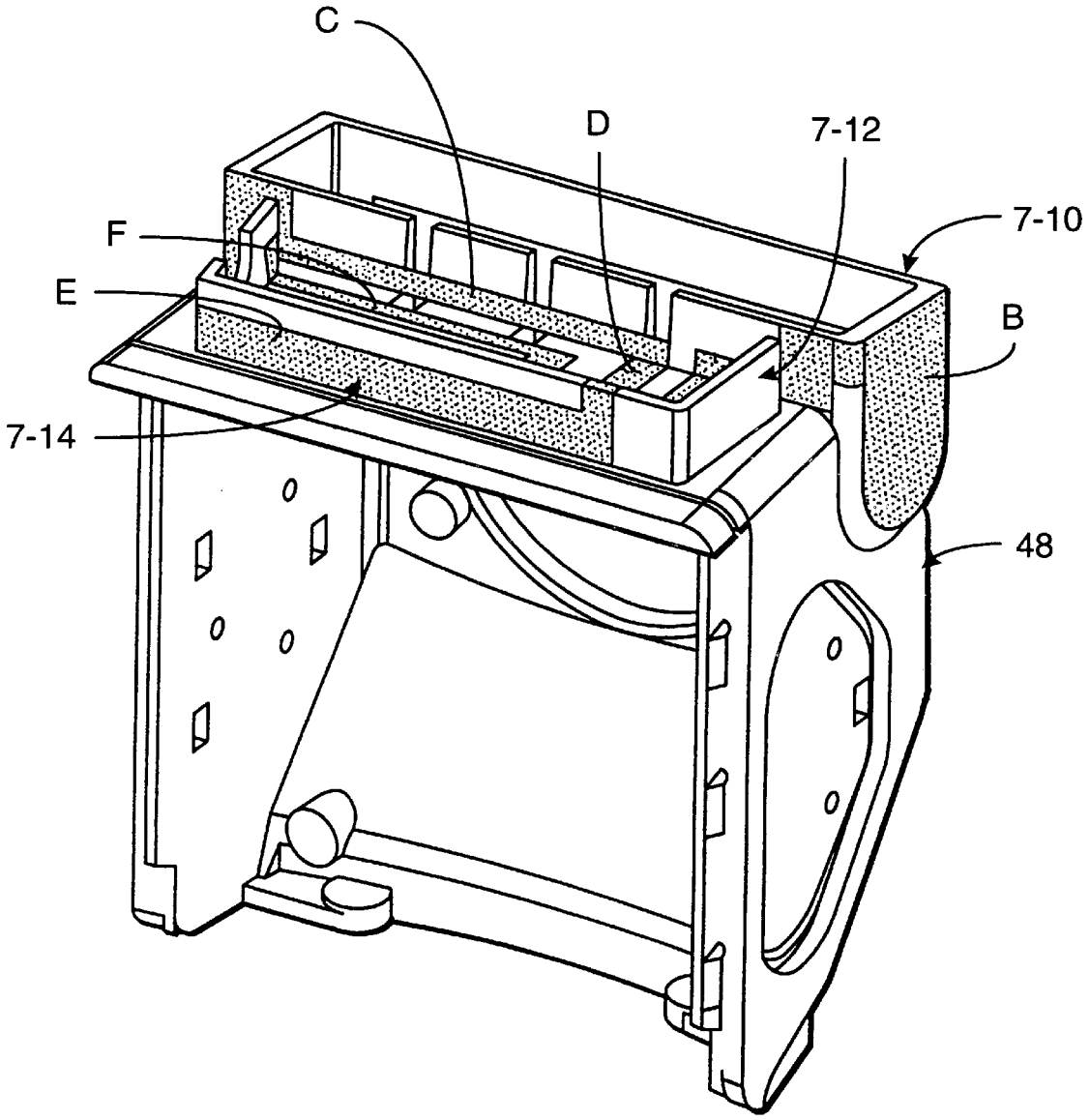
FIG. 7 is an isolated perspective view of a frame of a modular add-on to a terminal such as FIG. 1 with the radiating element of FIG. 6A conformally placed in position.
Figure 8:
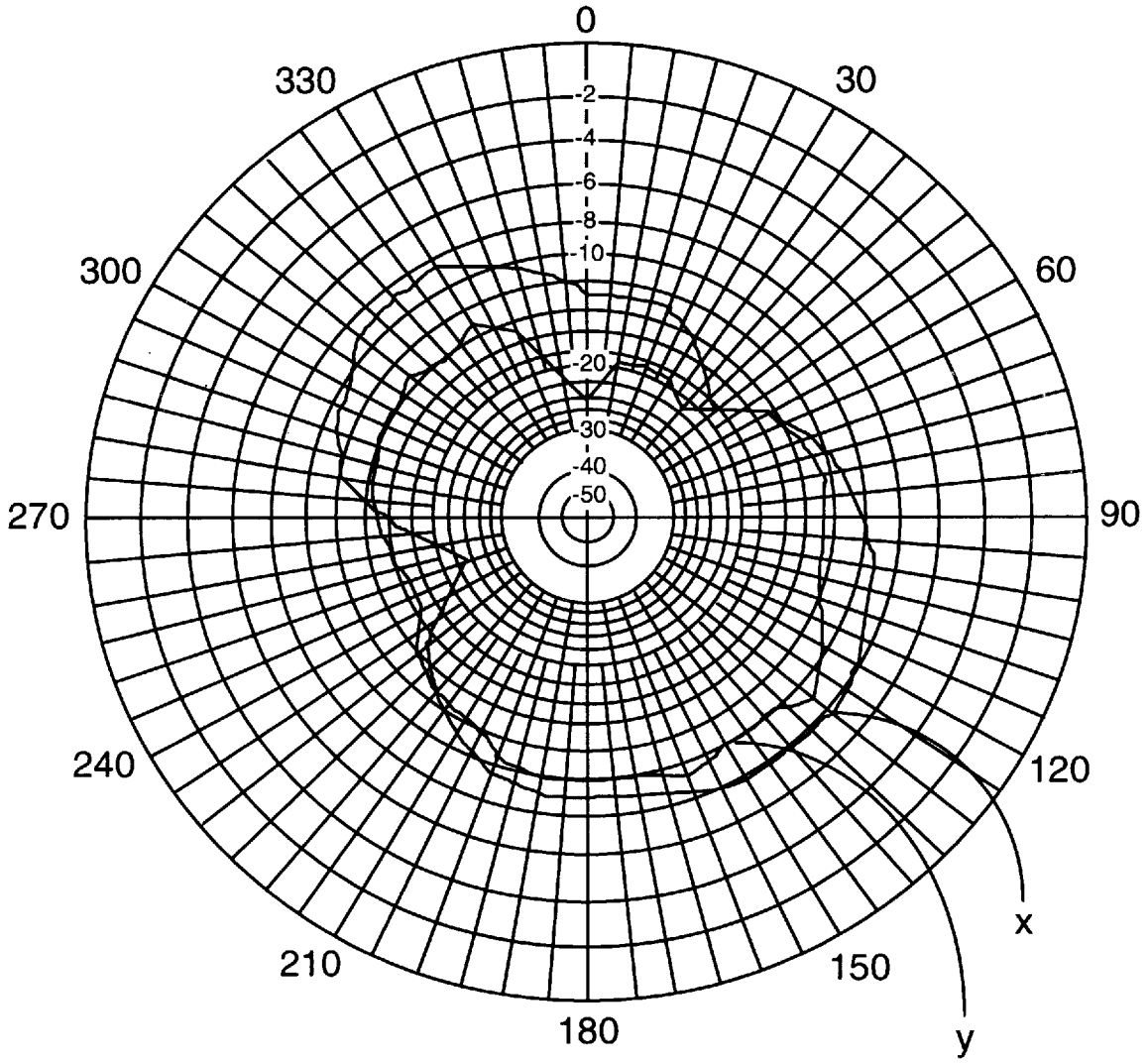
FIGS. 8–12 are antenna radiation patterns comparing the performance of radiating element of FIG. 7 with a conventional helical stub antenna such as shown in FIG. 1.
Figure 9:
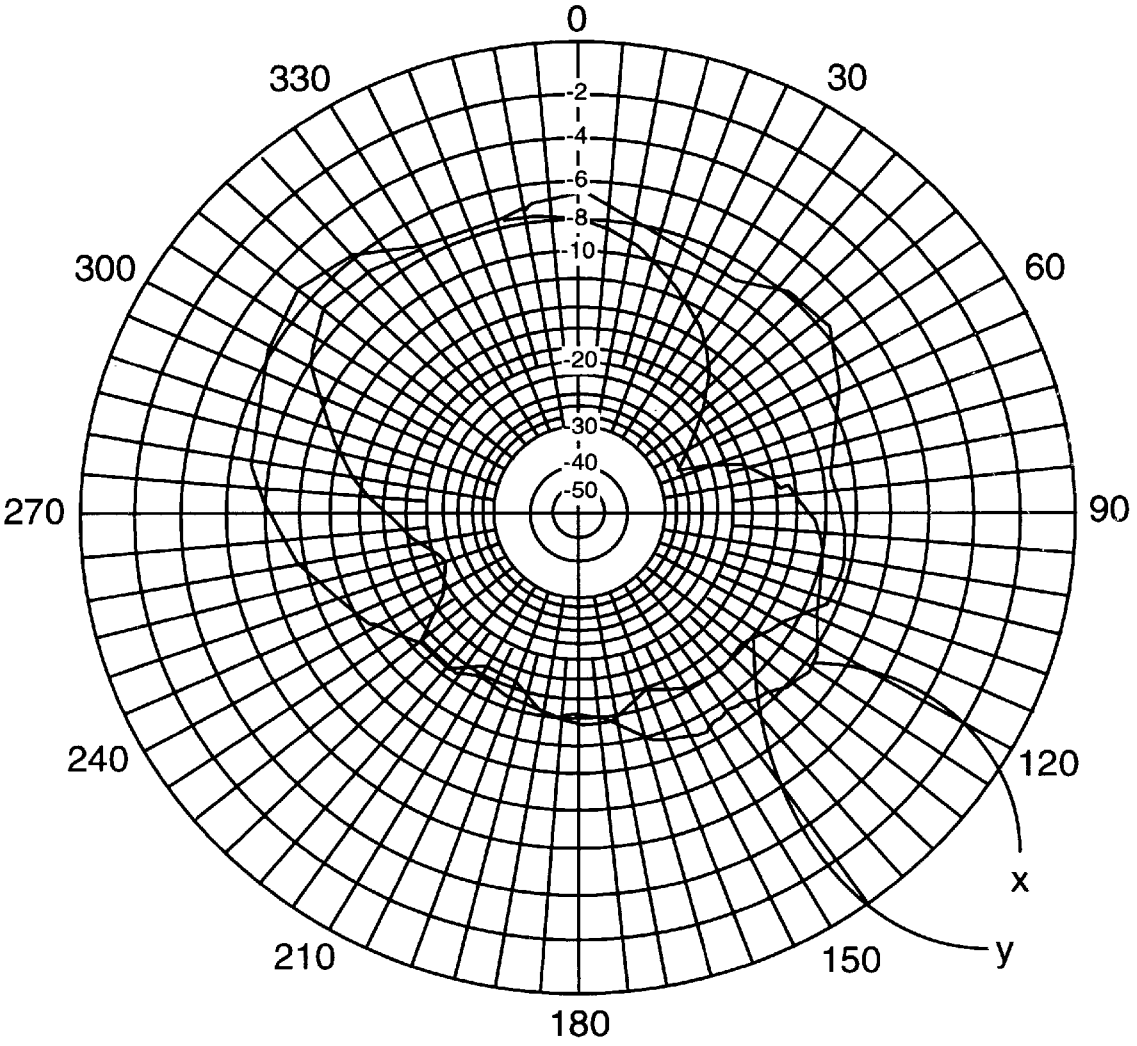
Figure 10:
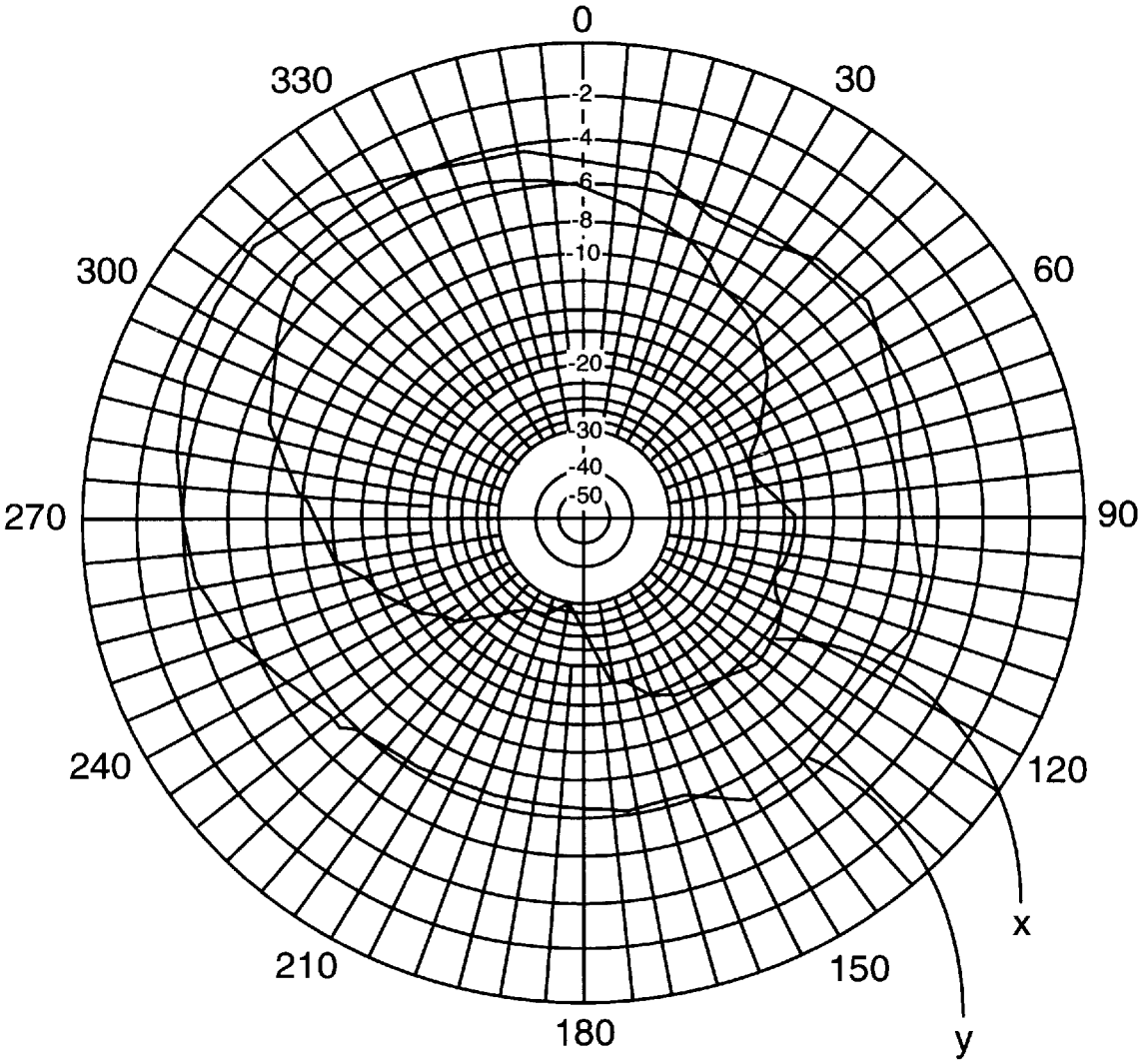
Figure 11:
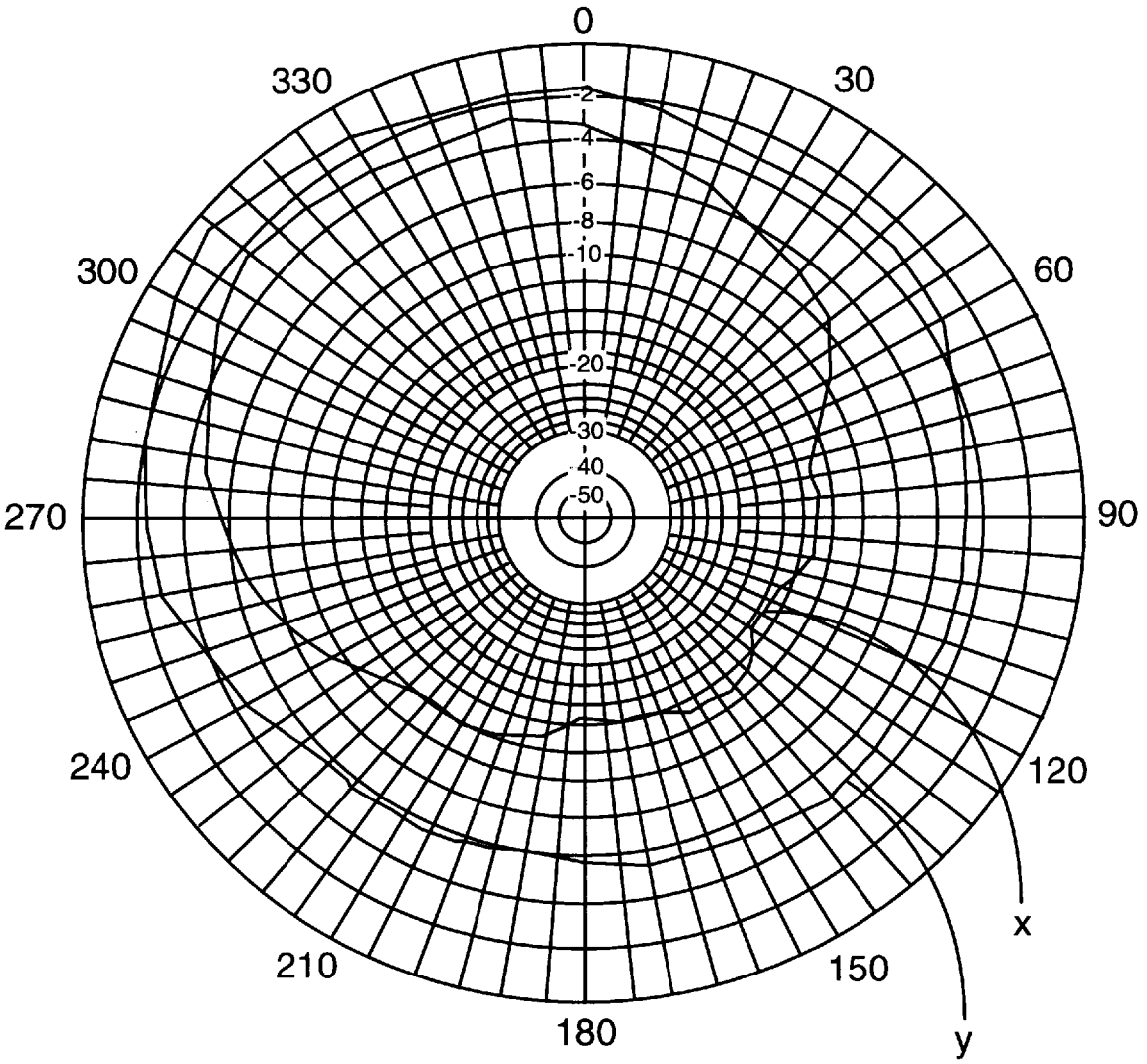
Figure 12:
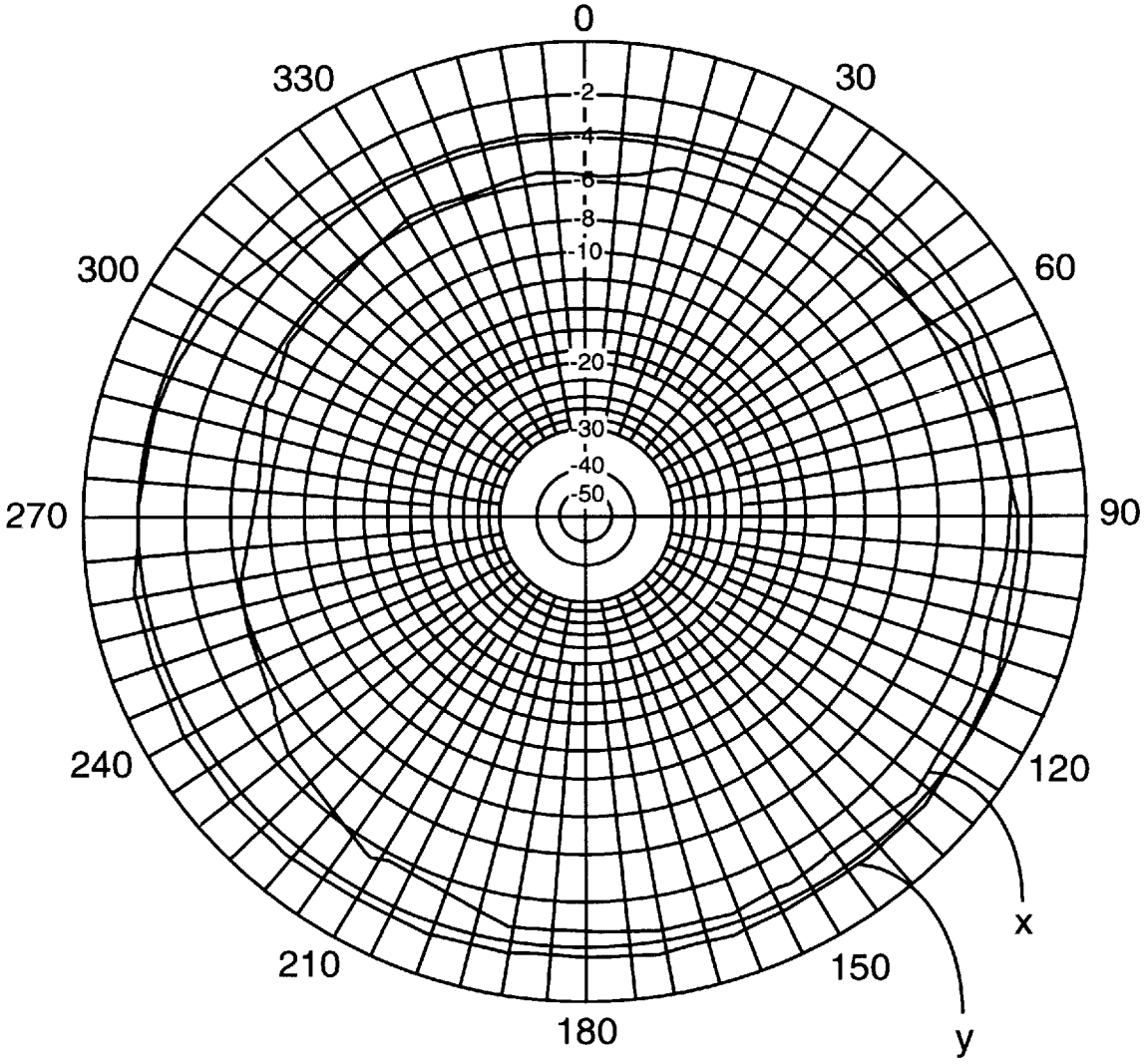

FIG. 5 shows an exploded view of the contents of module (48). FIGS. 1–4 show a conventional helical stub antenna (41) can be used in association with each module for RF transmission and reception. FIGS. 6A, 6B and 7, however, illustrate an antenna that can be utilized internally of the module as a replacement to the stub antenna. FIGS. 8–12 are antenna radiation pattern results illustrating the general equivalent performance of the antenna of FIGS. 6A and 7 with a conventional helical stub antenna.

Referring now to FIGS. 1–5, the basic environment for the invention will be discussed. In addition to this description, reference should be taken to commonly owned and co-pending U.S. patent applications 07/426,135, to George E. Hanson, filed Oct. 24, 1989, and to U.S. Ser. No. 07/735,610 to George E. Hanson, filed Jul. 7, 1991. FIGS. 1–5 correspond directly to FIGS. 1–4 and 6, respectively, of Ser. No. 07/735,610, and identical reference numerals used in those drawings are utilized in the present drawings for simplicity. The above two co-pending, co-owned applications are incorporated by reference herein.

FIG. 1 shows a radio frequency (RF) transceiver (10) having a housing (14), a stub antenna (41), and a display (19), as well as such features as a keyboard, connectors, and other components as are fully explained in the above mentioned applications. These type of devices are relatively small in size (palm-size) and are easily transportable. They operate on rechargeable batteries and therefore are completely portable. The device can send and receive RF communications utilizing such battery power.

In this particular embodiment, housing (14) is made of relatively rigid plastic material. Additionally, as shown in both FIGS. 2 and 3, portions or modules for the housing such as shown at (48) in FIG. 2, and (51) in FIG. 3, can be removed. The purpose for this ability is to either gain access to the interior of the device (10), to allow interchangeable components to be used with the device (10), or otherwise enhance the flexibility of such devices.

Figure 2:
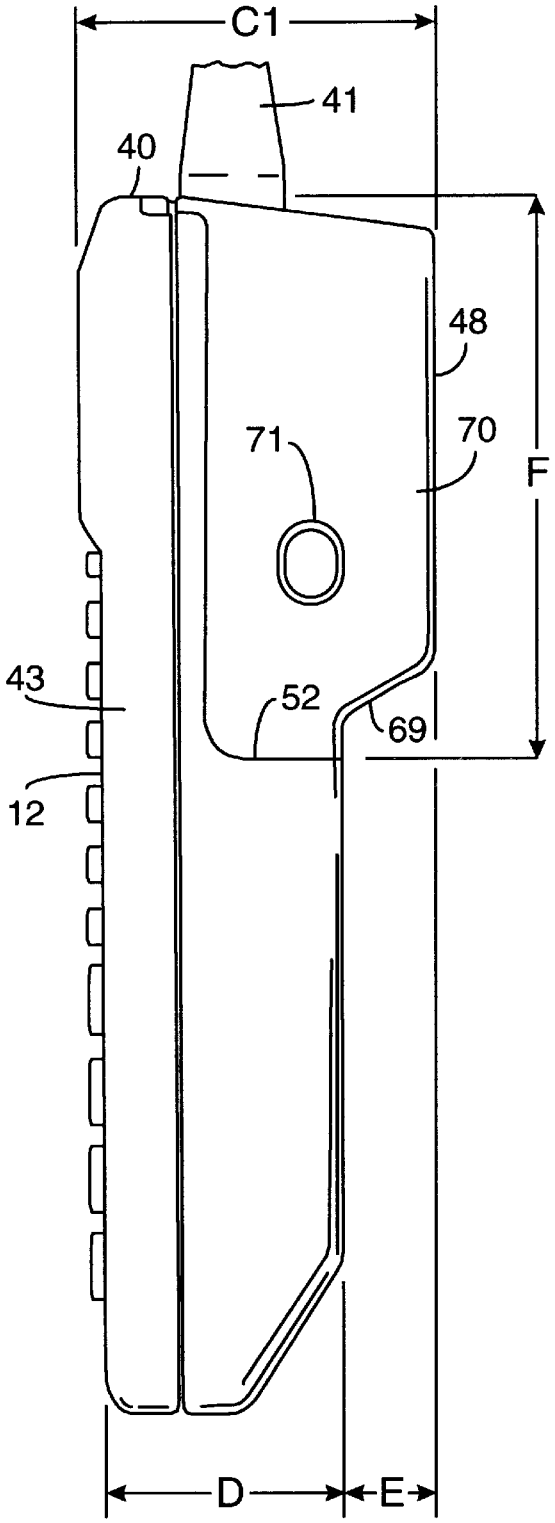
(Prior Art) FIG. 2
FIG. 2 is a side view of FIG. 1 showing a modular removable component including a helical stub mount antenna.
Figure 3:
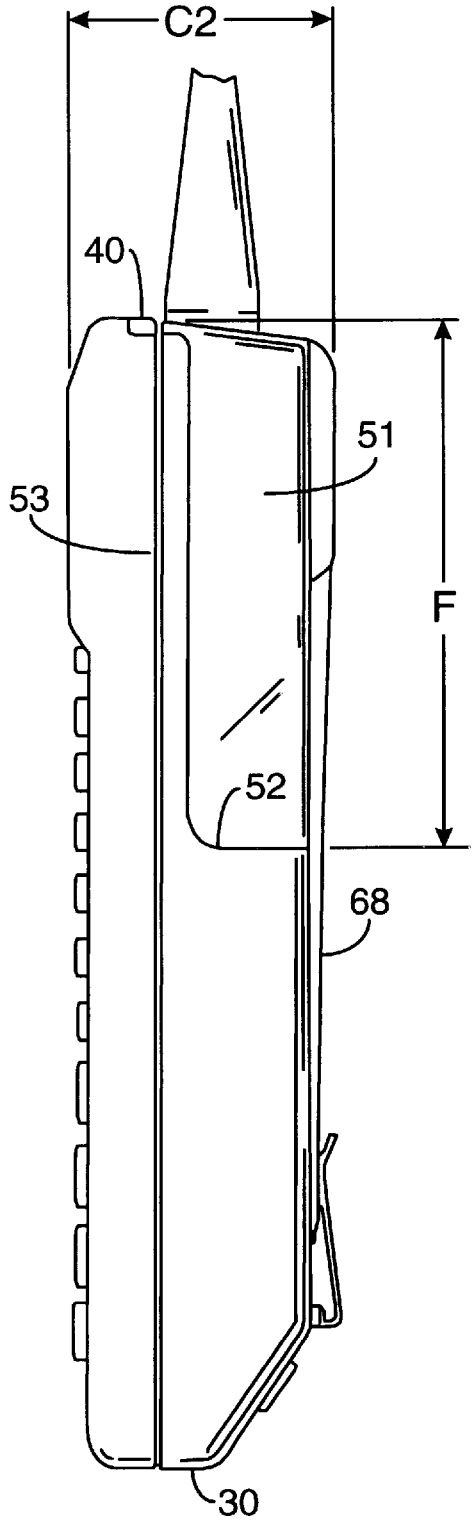
(Prior Art) FIG. 3
FIG. 3 is a side view of FIG. 1 showing an alternative modular add-on component with a helical stub antenna.

It is to be noted that in both FIGS. 2 and 3, components or modules (48) or (51) can be removed (such as is illustrated in FIG. 4), and both have the stub antenna (41) connected thereto.

By referring more specifically to FIG. 5, module (48) (such as is shown in FIG. 2), is shown in isolation along with the components that would be assembled into what will be called module housing or frame (48). It is noted that stub antenna (41) is shown as removed but would be secured at the antenna mount (78) on frame (48).

It can therefore be seen that devices of this type are manufactured to receive the many components shown in FIG. 5, which are densely packed into frame (48).

Elimination of the stub antenna presents significant problems. As previously described, the very nature of electrical components generally results in framework or mounting surfaces which are of complex shape and form to provide mounting structures for the components that must be packed into the device. Additionally, those components must be closely packed inside the frames or housings of these devices. This close packing does not lend itself to easy placement of an antenna within such a framework or housing.

Additionally, as previously described, the antenna performance and characteristics for such devices are not merely solved by utilizing plate antennas such as are shown and described in U.S. Pat. No. 4,958,382 by inventor Imanishi (see particularly FIGS. 3 and 4), or interior antennas such as shown in incorporated by reference Ser. No. 07/426,135 at FIGS. 2 and 4, in particular.

Still further, many times it is not desirable or possible to utilize the exterior surface type antenna shown at (70) in U.S. Pat. No. 3,826,900 to inventor Moellering (see particularly FIG. 2).

Elimination of stub antenna (41), from the present type of device (10), therefore requires consideration of at least the following factors:

1. shape of device (10) and frame (48) or (51),
2. room externally and internally in the assembled device (10),
3. the required gain for the antenna,
4. VSWR performance,
5. frequency of operation,
6. other functional needs of device (10) beyond RF transmission and reception (such as the need to move the device close to a bar code if a bar code reader, for example, is incorporated into the device).

In the preferred embodiment of the present invention, frame (48) could take on a configuration generally as shown at FIG. 7. Frame (48) would basically attach to the top and back of device (10) and would include components similar to those shown in exploded fashion in FIG. 5 (but not shown in FIG. 7). Additionally, a rectangularly shaped box (7-10) is integrally formed to the rear top of frame (48) as shown in FIG. 7. The interior of box (7-10) is configured to receive a device such as a bar code scanner element (not shown).

Such a scanner would have to be movable into close proximity with bar codes to be read and therefore the top of device (10) and the area around frame (48) must be clear of any structure which would inhibit such placement; this is one reason for the elimination of stub antenna (41) in the preferred embodiment.

It is also noted that a wall (7-12) is integrally formed on the top of frame (48) and in front of box (7-10).

In the particular embodiment shown in FIG. 7, therefore, placement of an antenna (7-14) is a non-trivial matter. The design characteristics set forth above reveal substantial hurdles to successfully incorporating an antenna in such a configuration.

By referring to FIGS. 6A and 7 together, the preferred embodiment can be explained in more detail. FIG. 6A illustrates antenna element (7-14) prior to conforming insertion to frame (48). In the preferred embodiment antenna element (7-14) is made of one thin layer of copper (shown facing up in FIG. 7) bonded to a thin layer of insulating material (not shown). As can be seen in FIG. 6A, a central portion (7-16) of the antenna is bounded by a long arm (7-18) and a shorter arm (7-20) which extend from opposite ends of the middle portion (7-16). Additionally, ears 7-22 (or "B") and 7-24 (or "B") extend from middle portion (7-16).

FIG. 6A also shows that the basic geometry of antenna (7-14) can be manufactured out of a planar sheet of copper and a planar layer of insulating material. Both such materials must be flexible for conforming placement onto device (10) such as shown in FIG. 7.

It is furthermore noted that in the preferred embodiment, the extreme end of short arm (7-20) is electrically connected to a nickel/gold pad (7-26) which can be used to connect antenna (7-14) to connection circuitry for electrical communication to the electrical components of transceiver device (10).

As can be seen in FIG. 7, the structure and geometry of frame (48) are preestablished. They must therefore be taken into consideration by the designer.

The performance requirements of an antenna have previously been established for transceiver device (10). The stub antenna (41) is one form an adequate antenna could take. Therefore, the designer has information regarding antenna performance characteristics upon which to judge the acceptability of performance and the design of antenna (7-14). In the preferred embodiment, the designer understands that both length of antenna (7-14) as well as the makeup and proximity of the parts of the antenna (7-14) affect such performance.

FIG. 6A specifically identifies various portions of antenna (7-14) by the reference letters A through F. By direct comparison to FIG. 7, it can be seen where these components are finally placed within the structure of frame (48). As is obvious, the antenna (7-14) must be bent, shaped, and otherwise conformed to the various surfaces of frame (48). Portions B are utilized in part as basically anchor sections on opposite sides of box (7-10). The middle portion (7-16) would run along the back side of box (7-10) in FIG. 7. Short arm (7-20) wraps around the front of box (7-10) and pad (7-26) lies horizontally along the top surface of frame (48) for connection to other circuitry.

In comparison, long arm (7-18) portion C would wrap around the opposite front side of box (7-10) and travel along said front of box (7-10) until it is basically adjacent but not touching short arm (7-20) portion A. The antenna (7-14) then (at portion D) travels forwardly over wall (7-12) and then back along the front of wall (7-12) (portion E), until wrapping around and inside of wall (7-12) ending in section F (the "J-shaped" portion).

The various portions of antenna (7-14) indicated by letters never abut one another but closely conform to each of the surfaces of frame (48) upon which it is placed. Essentially, antenna (7-14) is a very thin, surface-covering decal which fits well within the confines of frame (48). It can be attached by glue or adhesive such as is within the skill of those skilled in the art.

Referring now to FIG. 6B, an another embodiment of an antenna (7-14B) built in accordance with the present invention is illustrated. Clearly, the general shape of the alternate antenna (7-14B) is the same as the antenna (7-14) shown in FIG. 6A and is similarly designed to conform to the shape of the frame (48) of the device (10). However, the antenna (7-14B) as in the embodiment shown in FIG. 6B has particular advantages which will be made clear below.

The antenna (7-14B) comprises two basic parts: a backing layer (6-1B) and a receiving or radiating layer (6-2B). The backing layer (6-1B) is constructed of a resiliently flexible, non-conductive substance, such as plastic, while the receiving layer (6-2B) is constructed of an electrically conductive substance, such as copper, which is suitable for the reception of radio signals. Furthermore, these two layers (6-1B, 6-2B) are joined together in a permanent way, preferably at all common surfaces. This joining could, for example, be accomplished through the use of an appropriate epoxy. Thus the backing layer (6-1B) provides structural support to the receiving layer (6-2B) and further provides a way for the antenna (7-14B) to be attached to the device frame (48) without contact between the receiving layer (6-2B) and frame (48).

The receiving layer (6-2B), when followed from a first tab (6-3B) to a third tab (6-4B), is constructed in a pattern which is a linear path (6-5B) containing numerous angled turns such that the path (6-5B) never crosses itself and is directed mainly by the boundary provided by the backing layer (6-1B). When considered in this way, the effective length of the receiving layer (62B) is augmented significantly while its true length remains constant and compact. Thus, the linear length of the antenna is significantly increased while the direct distant measured end to end remains relatively short. This effective lengthening is advantageous in an antenna with respect to transmission and reception of electromagnetic signals.

Of course, the characteristics of the path (6-5B), for example, pattern, number of turns, shape of turns, or width, could be varied and thus FIG. 6B serves only to illustrate one of myriad possibilities. For example, the numerous turns need not be angled turns but instead could be curved turns comprised of arcs of the same or varying size. The essence of the invention is to take a predefined boundary shape having an overall length, in this case the shape determined such that the antenna will conformally fit within a frame, and weave an electrically conductive substance back and forth to create a linear length significantly longer than the predefined length.

The specific shape of the antenna (7-14B) also provides the advantage of optional fundamental configurations. Specifically, once conformed to the shape of the device frame (48), the first tab (6-3B) and the second tab (6-6B) are connected in a suitable way to RF circuitry within the device (10) with the first tab (6-3B) connected to ground and the second tab (6-6B) connected to the antenna feed. Connected as such, a typical grounded antenna is formed. The third tab (6-4B) may be optionally put in electrical contact with a first tab (6-3B) resulting in a grounded loop antenna. If grounding is unnecessary, then the first and third tab can selectively either be connected or not connected depending on the type of antenna desired. Furthermore, the close proximity of the third tab (6-4B) to the first tab (6-3B), which results in the optional configurations, is a result of conscious design considerations of the conformation antenna (7-14B) to the device frame (48).

FIGS. 8–12 are antenna radiation pattern plots of the performance of antenna (7-14) in comparison to stub antenna (41). It can be seen that the various angles of measurement are between horizontal and vertical, and the performance of antenna (7-14) fairly closely approximates that of stub antenna (41). In each drawing the plot for the conformed antenna is labelled "X" and the plot for the stub antenna as "Y".

It is to be understood that the above described embodiment of antenna (7-14) is specifically configured for the shape of frame (48) and the operating characteristics of device (10). It is to be clearly understood that similar design criteria can be utilized for other physical shapes for devices to which an antenna according to the invention is to be applied.

The present invention can be utilized with a wide variety of radio frequency transceiving devices. Some examples are personal computers, printers, computers, televisions, or any other device that transmits or receives communications over RF frequencies.

Although linear and similar simple geometry antenna characteristics are basically defined by an antenna's length, attempts at creating conformal antennas by simply placing a similar length of foil along the surface of a transceiver housing has met with disappointing results. A conformal antenna placed within the housing of an electronics apparatus must be shielded from the electronics contained therein. For this reason, a metal surface separate from the foil antenna, is interposed between the antenna and the enclosed electronics. Placing the antenna in close proximity to the shield, as is well known in the art, will produce a profound effect on the antenna's impedance. Additionally, the complex shape required of a conformal antenna will affect its impedance. Because of these effects on the antenna's impedance created through the aforesaid mechanisms, the antenna's performance will be adversely effected unless compensation is made for the impedance effects.

The present invention provides a new technique to compensate for the complex interactions between an electronics housing, the sometimes convoluted geometries of a conformal antenna, and their effects on the antenna's performance.

FIGS. 1–12 therefore show that a replacement for a conventional helical stub antenna can be achieved by internally mounting an antenna of the type of FIGS. 6A, 6B and 7 to a module that can be releasably connected to a hand-held terminal (10). The invention therefore eliminates the problems associated with the stub antenna while maintaining equivalent or even improved antenna performance. The antenna also is directly built into each module requiring an antenna. Therefore, it eliminates the need or use of an antenna if a module does not require an antenna. Antennas of the present invention need not, of course, be modular, the present invention includes integral antennas as well.

FIGS. 13–15A-E

Another aspect of the invention is shown at FIGS. 13–15A-E. It is important that the performance of an antenna such as that shown in FIGS. 6A, 6B and 7 not be substantially different than that of a helical stub antenna. One factor which can impact on the performance of an internally mounted antenna is the fact that physical structure is generally required to cover the antenna to prevent it from exposure and damage. Material must be selected to accomplish the function of protection, yet must be as electromagnetically permeable as possible. Still further, its physical shape and size preferably should be in conformance with the shape of the hand-held terminal and not substantially extend or increase the outer dimensions of the terminal.

Figure 13:
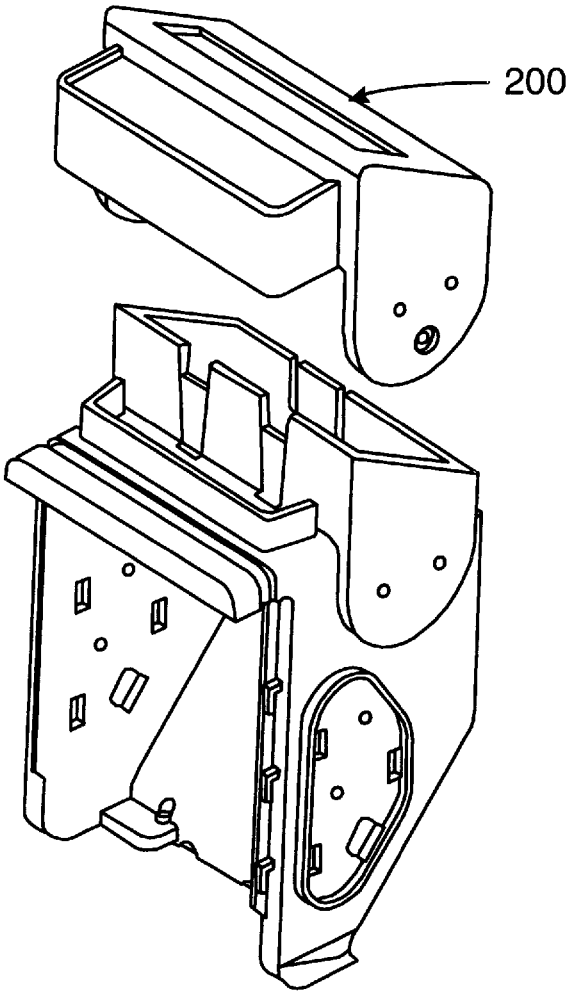
FIG. 13 is similar to FIG. 7 but additionally showing a removable cover in exploded fashion from the top of modular FIG. 7.

An example of this concept is shown in FIG. 13, in relation to the antenna and module shown at FIG. 7. A cover piece (200) as shown in FIG. 13 is mountable directly over the top portion of module (48). It would completely cover and encapsulate antenna (7-14) and any other components (not shown) and provide protection from the elements and environment, as well as physical contact.

In the preferred embodiment, cover (200) closely conforms to the shape of the top of module (48). It is made of a dielectric material which is somewhat flexible. Therefore, it can protectively cover the antenna without compromising any shielding that may be required between the antenna and internal circuitry of the terminal, which might occur if, for example, the antenna were placed internally of the structure of the module (48).

Figure 14:
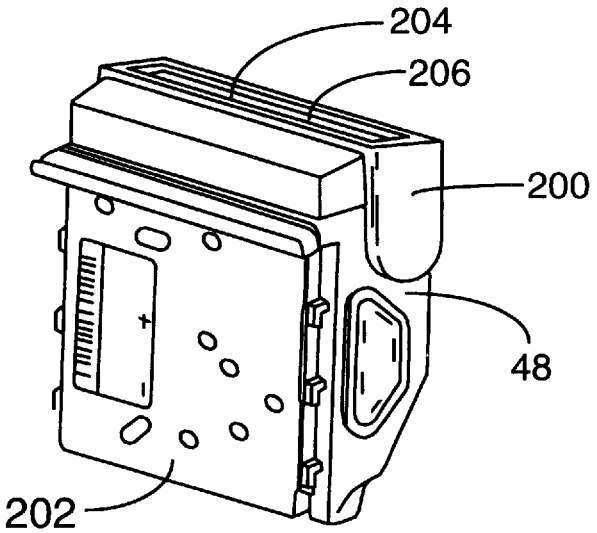
FIG. 14 is an assembled view of the module according to FIG. 13, including the assembled cover piece and assembled back piece.
Figure 15A:
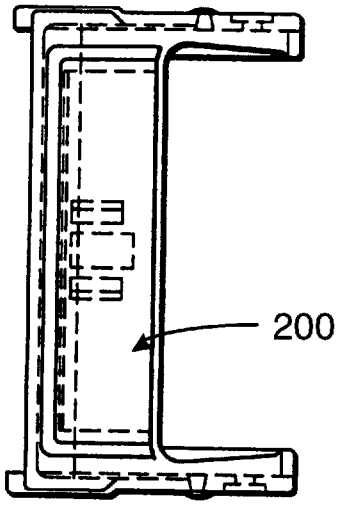
FIGS. 15A–15F show isolated views, some of which are partially sectional views, of the cover piece of FIGS. 13 and 14.
Figure 15B:
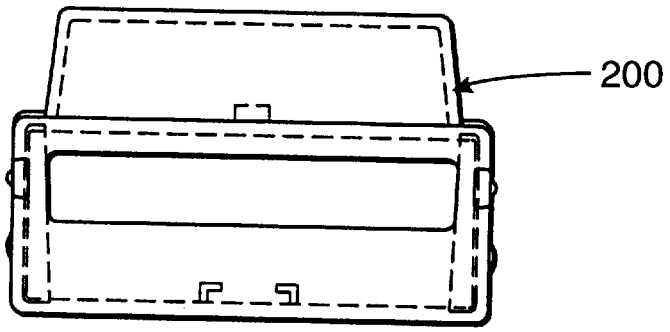
Figure 15C:
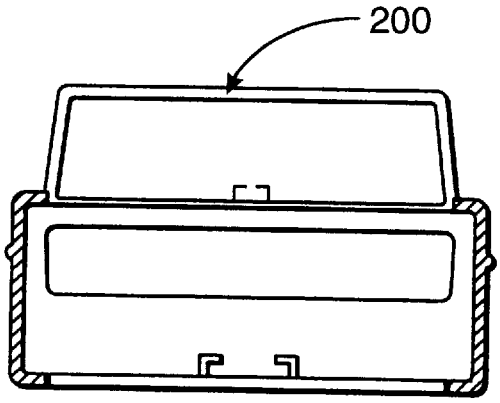
Figure 15D:
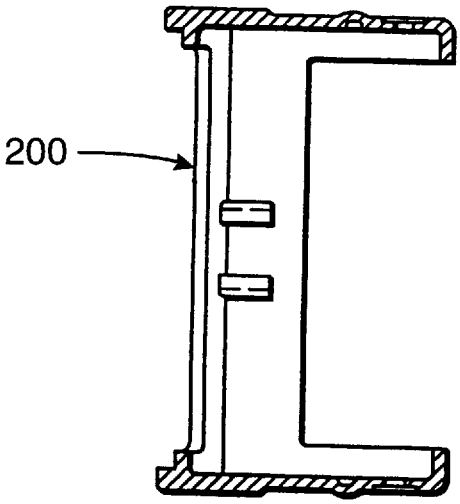
Figure 15E:
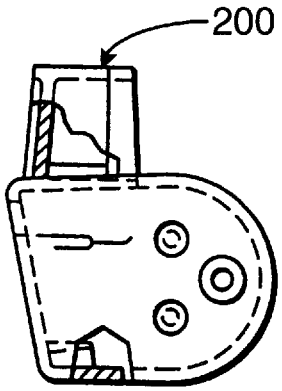
Figure 15F:
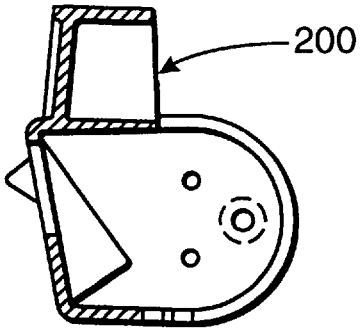

FIG. 14 shows cover (200) as positioned over the top of module (48) and the antenna (7-14) (not shown). Additionally, a cover plate (202) is shown as attached over the interior chamber module (48) to complete the housing for module (48).

In this embodiment, module (48) comprises an RM20 CCD integrated scanning module for the RT1000/1100 UHF radio terminal available from Norand Corp., Cedar Rapids, Iowa.

As can be seen in FIGS. 13 and 14, cover (200) also accommodates an opening (204) for access to a scanner lens (206) according to the functioning of this module (48). The antenna, and its covering components, therefore do not interfere with the functions of this module, even though those functions are directly adjacent the position of the antenna.

FIGS. 15A–15F are specific views showing the exact structure of cover (200).

In this preferred embodiment, cover (200) is made of santoprene 201-73 available from Advanced Elastomer Systems. The outer surfaces of cover (200) can be somewhat textured if desires.

It is noted that the mounting of the antenna on module (48) is at the top of module (48). Therefore, electromagnetic radiation has primarily only to pass through cover (200) to reach the antenna 7-14. In this embodiment, the antenna 7-14 is as previously described with respect to FIGS. 6 and 7 and closely conforms to the surfaces of module (48) and is wrapped around the upper surfaces of module (48).

Obviously, many modifications and variations of the present invention are possible in light of the above teachings. It is therefore to be understood that, within the scope of the appended claims, the invention may be practiced otherwise than as specifically described.

I claim:

1. An antenna system for a portable data terminal comprising a terminal housing and a radio circuit unit having a three dimensional shape, said terminal housing receiving the radio circuit unit, said antenna system comprising:

an antenna assembly comprising a backing layer and a radiating layer;

said backing layer being constructed of a non-conductive material having an overall width, and having a three dimensional shape closely conformed to at least part of the three dimensional shape of the radio circuit unit;

said radiating layer comprising conductive material having a weaved pattern disposed on said backing layer in a three dimensional shape;

said terminal housing encloses said antenna assembly; and said antenna assembly being coupled to the radio circuit unit to form a unitary assembly independent from the terminal housing.

2. The antenna system of claim 1, wherein the portable data terminal comprises a host and an interchangeable module, and the radio circuit unit is disposed within the interchangeable module.

3. The antenna system of claim 2, wherein the unitary assembly of the radio circuit unit and the antenna assembly has a shape conformed to an interior shape of the interchangeable module.

4. The antenna system of claim 1, wherein the radio circuit unit comprises a mounting frame and radio circuitry received within the mounting frame and the shape of the backing material is conformed to a shape of at least a portion of the mounting frame.

5. The antenna system of claim 4, wherein the radiating layer further comprises at least one connecting pad that provides a connection between the radiating layer and the radio circuitry.

6. The antenna system of claim 5, wherein the at least one connecting pad provides a pressure connection between the radiating layer and the radio circuitry.

7. The antenna system of claim 4, wherein the radio circuit unit further includes shielding disposed between the antenna assembly and the radio circuitry.

8. The antenna system of claim 1, wherein the terminal housing has a single cavity.

9. A radio assembly for use with an electronic device having a housing that encloses the radio assembly, the radio assembly comprising:

a radio circuit unit having a three dimensional shape;

a flexible antenna having a conductive layer in a weaved pattern, coupled to the radio circuit unit, said flexible antenna having a three dimensional shape closely conformed to at least a part of the three dimensional shape of the radio circuit unit; and the radio circuit unit and flexible antenna forming a unitary operable assembly.

10. The radio assembly of claim 9, wherein the electronic device comprises a host unit and an interchangeable module with the radio assembly disposed within the interchangeable module.

11. The radio assembly of claim 9, wherein the radio circuit unit comprises a mounting frame having a shape and radio circuitry received within the mounting frame, the flexible antenna having a shape closely conformed to at least a portion of the shape of the mounting frame.

12. The radio assembly of claim 11, wherein the flexible antenna further comprises at least one connecting pad that provides a connection between the flexible antenna and the radio circuitry.

13. The radio assembly of claim 12, wherein the at least one connecting pad provides a pressure connection between the flexible antenna and the radio circuitry.

14. The radio assembly of claim 11, wherein the radio circuit unit further comprises shielding disposed between the radio circuitry and the flexible antenna.

15. The radio assembly of claim 9, wherein the housing of the electronic device defines a single cavity.

16. The radio assembly of claim 9, wherein the flexible antenna comprises:

a conductive radiating layer; and an insulating backing layer.

17. An antenna system for a portable data terminal comprising a radio circuit unit and a terminal housing having a three dimensional shape, said terminal housing receiving the radio circuit unit, said antenna system comprising:

an antenna assembly, coupled to the radio circuit unit, comprising a radiating layer;

said radiating layer having a three dimensional shape closely conformed to at least part of the three dimensional shape of the terminal housing, and said radiating layer comprising a conductive material having a weaved pattern; and said terminal housing encloses said antenna assembly.

18. The antenna system of claim 17, wherein said antenna assembly is coupled to the radio circuit unit to form a unitary assembly independent from the terminal housing.

19. The antenna system of claim 18, wherein the portable data terminal comprises a host unit and an interchangeable module, and the unitary assembly being disposed within the interchangeable module.

20. The antenna system of claim 19, wherein the unitary assembly having a shape conformed to an interior shape of the interchangeable module.

* * * * *